US005760804A

United States Patent [19]

Heinzl et al.

[11] Patent Number: 5,760,804

[45] Date of Patent: Jun. 2, 1998

[54] INK-JET PRINTING HEAD FOR A LIQUID-JET PRINTING DEVICE OPERATING ON THE HEAT CONVERTER PRINCIPLE AND PROCESS FOR MAKING IT

[75] Inventors: Joachim Heinzl; Bernhard Hochwind; Hans W. Pötzlberger, all of München; Helmut Schlaak; Arno Steckenborn, both of Berlin, all of Germany

[73] Assignee: Eastman Kodak Company, Rochester, N.Y.

[21] Appl. No.: 952,628

[22] PCT Filed: Apr. 26, 1991

[86] PCT No.: PCT/DE91/00364

§ 371 Date: Jan. 21, 1993

§ 102(e) Date: Jan. 21, 1993

[87] PCT Pub. No.: WO91/17891

PCT Pub. Date: Nov. 28, 1991

[30] Foreign Application Priority Data

May 21, 1990 [DE] Germany ..... 40 16 356.3

[51] Int. Cl.[6] ..... B41J 2/05

[52] U.S. Cl. ..... 347/56; 347/57; 347/61

[58] Field of Search ..... 347/56, 57, 59, 347/61, 62, 55

[56] References Cited

U.S. PATENT DOCUMENTS

| | | | |
|---|---|---|---|
| 4,333,086 | 6/1982 | Ebi | 347/55 |
| 4,580,149 | 4/1986 | Domoto et al. | 347/62 |
| 4,633,274 | 12/1986 | Matsuda | 346/140 R |
| 4,675,693 | 6/1987 | Yano | 346/1.1 |
| 4,847,630 | 7/1989 | Bhaskar et al. | 347/63 |
| 4,873,622 | 10/1989 | Komuro et al. | 346/140 R |

FOREIGN PATENT DOCUMENTS

| | | | |
|---|---|---|---|
| 0 221 724 A3 | 10/1986 | European Pat. Off. | B41J 3/04 |
| 0 367 303 A1 | 4/1987 | European Pat. Off. | B41J 2/05 |
| 0 322 228 A2 | 12/1988 | European Pat. Off. | B41J 3/04 |
| 1-064858 | 3/1989 | Japan | 347/58 |
| 2-67141 | 3/1990 | Japan | 347/56 |
| WO 87/03364 | 6/1987 | WIPO . | |

*Primary Examiner*—Benjamin R. Fuller
*Assistant Examiner*—Craig A. Hallacher
*Attorney, Agent, or Firm*—Thomas C. Pontani

[57] ABSTRACT

In an ink print head of sandwich type construction which works according to the bubble-jet principle, the heating elements, electric lines and contacts, as well as the shoot out openings are advantageously produced in the same chip by planar processing steps (back-shooter principle). The heating elements and the shoot out openings are arranged so as to be laterally offset relative to one another in such a way that the spreading direction of the steam bubble is directed opposite to the ink shooting direction. Such an arrangement results in a simple and accordingly inexpensive production of such ink print heads since all precision processing steps are advantageously effected in a planar process and joined on one element.

25 Claims, 1 Drawing Sheet

INK-JET PRINTING HEAD FOR A LIQUID-JET PRINTING DEVICE OPERATING ON THE HEAT CONVERTER PRINCIPLE AND PROCESS FOR MAKING IT

BACKGROUND OF THE INVENTION

1. Field of the Invention

The invention is directed to an ink print head for a liquid-jet printing device working on the heat converter principle as well as to a process for its manufacture.

2. Description of the Related Art

The lines to be printed (e.g. characters or graphic patterns) are produced by a plurality of ink drops; the patterns for each character are fixed in a so-called matrix.

In an advantageous manner, a full column of such a matrix is printed simultaneously so as to fulfil the requirements for high printing speed and uniform type face.

An ink print head suitable for the aforementioned printing process must thus combine a plurality of (identical) elements capable of shooting out ink drops at desired time intervals ("drop-on-demand" principle). A characteristic feature of this technology consists in that an electric resistor constructed as a heating element is located in a capillary filled with printing liquid, e.g. ink, specifically in the vicinity of its opening. When a determined heat energy is supplied to this heating element on demand by means of a current pulse, a rapidly expanding ink steam bubble is first produced by means of an extremely fast transfer of heat to the ink liquid (film boiling), which bubble bursts relatively quickly when the ink liquid cools after the supply of energy is cut off. The pressure wave formed by the steam bubble in the interior of the capillary allows an ink jet of limited mass to exit from the outlet opening onto the surface of a printing medium in proximity to it.

An advantage of this bubble-jet principle consists in that the relatively large and rapid change in volume necessary for shooting out the ink is obtained from a very small active converter surface (typically 0.01 $mm^2$) by utilizing the alternating liquid-gaseous-liquid phases of the ink liquid. The small converter surfaces in turn allow a relatively simple and inexpensive construction of ink print heads characterized by high printing track density and small dimensions with the use of modern production methods such as high-precision photolithography processes in film technology.

A basic configuration for a device working on the bubble-jet principle is described in DE 32 28 887 A1. In the known arrangement, also known as an "edge shooter", the heating surfaces, electric lines and contacts are likewise combined on a chip. The conduit structure can also be advantageously arranged as a photoresist structure. The outlet openings are first achieved by covering the conduit structure with a cover sheet which must be individually subjected to a mechanical high-precision processing along with the substrate and the conduit structure in every chip so as to achieve the necessary surface quality and edge sharpness at the outlet opening. Only after this processing can the outlet surface be coated with a surface film which can be heavily wetted. The magnitude of the drops may be varied only to a limited degree by varying the structure pulses to a heating element.

In accordance with the present invention, the ink print head has a plurality of outlet openings each of which is associated with at least one individually controllable electrothermal element. During printing operation, the converter elements locally heat an ink liquid, and ink liquid is shot out of the outlet openings by means of an ink steam bubble formed by the heat produced by the converter element. A supply vessel for storing ink liquid is mounted in flow connection with the outlet openings through supply lines. The converter elements are heating elements which are arranged so as to be laterally offset relative to the outlet openings in the shooting direction of the ink drops, so that the spreading direction of the ink steam bubble is directed opposite to the ink shooting direction.

The process according to the present invention provides that electric lines for the converter elements and their contacts, as well as the outlet openings, are produced in the same chip on a substrate by means of planar processing steps. The electrothermal converter elements are produced laterally next to the outlet openings above hollow spaces on the outlet side of the substrate which faces the outlet openings.

In this connection, an arrangement which works on the so-called "side shooting" principle is known from DE 30 12 698 A1. In such an arrangement the heating surfaces and the electric lines and contacts required for them are combined on a substrate. The conduit structure and allocation to the outlet openings, or nozzles, are formed by cementing a nozzle plate to the substrate with an exact fit.

An ink print head and a method for its production of the above-mentioned type are known from EP-A1-0-367 303. The known ink print head operates in accordance with the thermal converter principle and has a plurality of outlet openings associated with at least one individually controllable electrothermal converter element each, and a supply vessel for storing ink liquid which is in flow connection with the outlet openings. In this known ink print head and the known method, the above-described necessity of gluing a nozzle plate with exact fit onto a substrate is avoided because the electrothermal converter elements and the electrical supply lines for the converter elements as well as the outlet openings are produced in the same chip on a substrate. The outlet openings are produced on a conductor layer previously applied on the substrate by a galvanic nickel separation at specific locations (electroplating). Serving as frame and outline for the outlet openings to be produced are circular ring-shaped blocks which have previously been precisely positioned on the substrate and a cover plate. Therefore, the known ink print head requires, because of its operating principle (side shooting arrangement), a comparatively complicated manufacturing structure with a relatively large number of critical process steps.

SUMMARY OF THE INVENTION

In accordance with the present invention, the ink print head has a plurality of outlet openings each of which is associated with at least one individually controllable electrothermal element. During printing operation, the converter elements locally heat an ink liquid, and ink liquid is shot out of the outlet openings by means of an ink steam bubble formed by the heat produced by the converter element. A supply vessel for storing ink liquid is mounted in flow connection with the outlet openings through supply lines. The converter elements are heating elements which are arranged so as to be laterally offset relative to the outlet openings in the shooting direction of the ink drops, so that the spreading direction of the ink steam bubble is directed opposite to the ink shooting direction.

The process according to the present invention provides that electric lines for the converter elements and their contacts, as well as the outlet openings, are produced in the same chip on a substrate by means of planar processing steps. The electrothermal converter elements are produced laterally next to the outlet openings above hollow spaces on the outlet side of the substrate which faces the outlet openings.

The object of the invention is therefore to show steps for an ink print head of the type mentioned in the beginning which make it possible for the greatest possible number of operating members of such a print head, such as heating surfaces, ink conduits, outlet openings, ink feed and control connections, and the exact assignment of these operating members to be effected in an advantageous manner in planar processing steps on a plurality of print heads simultaneously and, in assembling the individual chips, to dispense with exact fits and mechanical subsequent processing as far as possible.

Moreover, the magnitude of the drops shot out of one and the same outlet opening can be varied in a simple arrangement.

The arrangement of nozzle, hollow space and heating element according to the invention provides an ink print head which is distinguished by simple and accordingly inexpensive production steps. In particular, all precision processing steps can be effected advantageously in a planar manner and are combined on one element, the magnitude of the drops from the same nozzle can be varied in a simple manner and the ink feed can be connected in a very simple manner.

DESCRIPTION OF THE PREFERRED EMBODIMENTS

Figure 1:
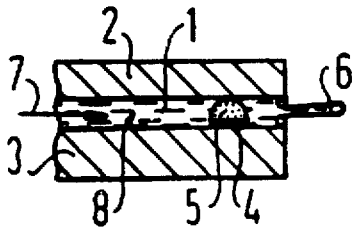
FIGS. 1 and 2 are basic diagrams of printing heads according to the prior art (edge-shooting principle in FIG. 1, side-shooting principle in FIG. 2)
Figure 2:
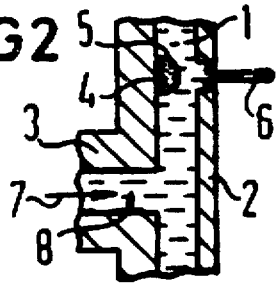

In FIGS. 1 and 2 the principles of drop shooting according to the prior art are shown in a schematic manner. FIG. 1 shows a so-called edge shooter and FIG. 2 shows a side shooter. The substantial difference between the two principles consists in the position of the heating element in the ink capillary with respect to the outlet opening. Operating members which work in the same manner are provided with the same reference numbers in FIGS. 1 and 2. An ink capillary 1 is supplied with ink liquid 8 in the ink feed 7 marked by the arrow. A heating element 4 in the form of an electric resistor is arranged in the ink capillary 1 on a substrate 3, e.g. of glass. In the configuration according to FIG. 1, the heating element 4 is arranged in the ink capillary 1 in such a way that the spreading direction of the ink steam bubble 5 is substantially offset by 90° relative to the shoot out direction of the ink droplet 6 (edge shooter). The ink capillary 1 is closed at the top by a cover plate 2. In a so-called side shooter arrangement according to FIG. 2, the heating element 4 lies directly below the outlet opening so that the main spreading direction of the ink steam bubble 5 coincides with the outlet direction of the ink droplet 6 and forms a geometrical line. The direction of the ink feed 7 into the ink capillary 1 is effected so as to be laterally offset relative to the position of the outlet opening. In so doing, the cover plate 2 assumes the function of a nozzle plate which is preferably cemented and in which the nozzle openings are inserted.

Figure 3:
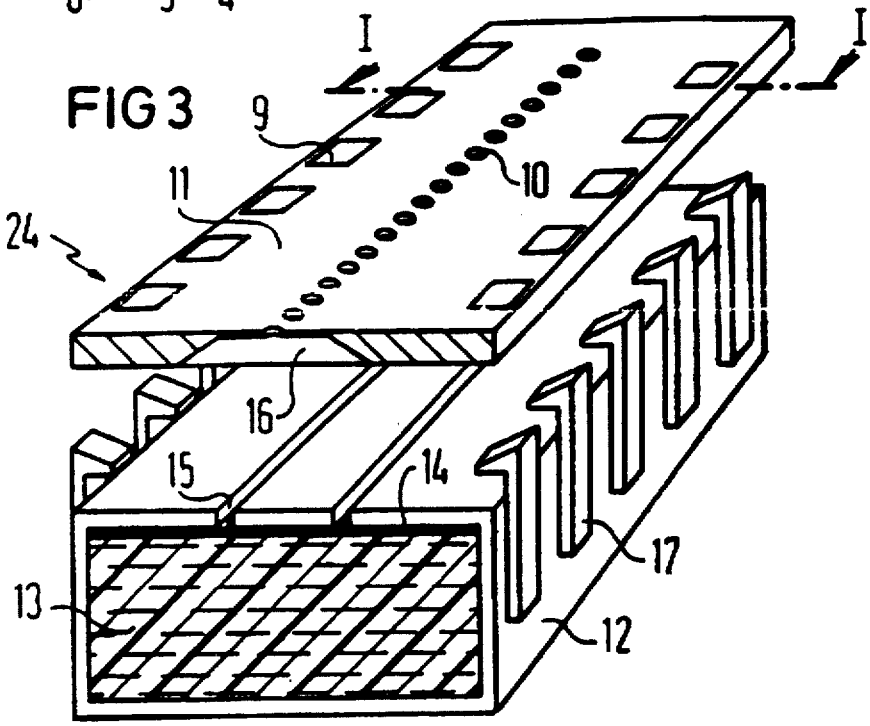
FIG. 3 is a schematic perspective view of the print head construction according to the invention.

FIG. 3 shows the construction of the ink print head according to the invention in a perspective view. This includes substantially only two parts to be connected with one another, namely a chip which contains the heating element, the electric leads and contacts for the electrical connection as well as the outlet openings (nozzles) and is fastened to and makes contact with a supply vessel while serving as a cover. The heating elements, not shown in this elementary drawing, the electric leads, contacts 9 and outlet openings 10 can be advantageously produced in a single chip 11, e.g. of silicon, with the use of planar processing steps.

The supply vessel 12 has a square shape in which is inserted a medium saturated with ink liquid, e.g. a sponge 13. But foam, such as melamine formaldehyde foam (MF) or the like foam materials can also be used as an ink storage.

Outlet openings in the form of two supply conduits 15 provided with filters 14 are provided at the upper side of the supply vessel 12 facing the chip. These supply conduits 15 extend parallel to one another in the longitudinal direction of the supply vessel 12 in such a way that when the chip 11 is assembled a flow connection is established between the supply conduits 15 and the outlet openings 10 via hollow spaces 16 which will be described in more detail in the following. The assembly of the chip 11 onto the supply vessel 12 is effected in a simple manner, without the need for exactly fitting parts and costly alignment, by means of assembly clamps 17 which are arranged at the longitudinal sides of the supply vessel 12 and serve for mechanically connecting and electrically contacting via contacts 9.

Figure 4:
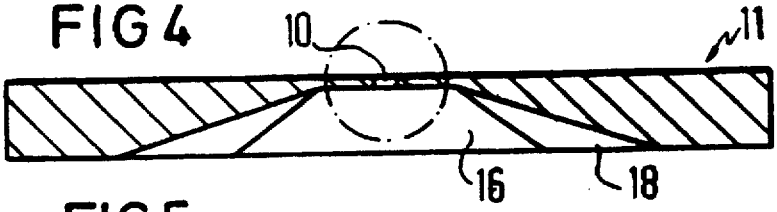
FIG. 4 is a sectional view through the chip of such a print head according to line I—I of FIG. 3.
Figure 5:
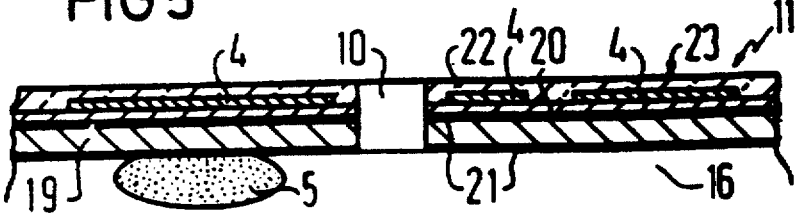
FIG. 5 is a sectional view of FIG. 4 in enlarged scale.

FIG. 4 shows a section through the chip 11 according to section line I—I in FIG. 3. The geometrical shape of a hollow space 16 having parallel walls and sloping run off zones 16 can be seen in particularly in this figure. The production of these hollow spaces 18 and the detailed construction of the chip 11 will now be explained with reference to FIG. 5 which shows an enlarged section from FIG. 4.

Doped silicon is used as substrate material 19. The hollow space structure 16 is formed by anisotropic etching. Monocrystalline silicon in orientation (110) is preferably used as a substrate and masking is effected during the etching via an elongated opening with parallel side edges so as to form hollow spaces 16 with parallel walls formed from (111) planes and sloping run off zones 18. This makes it possible for such hollow spaces to be arranged close to one another in rows. A thin carrier layer (diaphragm) 20 which is required for ensuring the conduction of heat from the heating element 4 to the ink-filled hollow space 16 is constructed in this etching process simultaneously in that the silicon 19 is thinly doped prior to etching in such a way that the etching process is halted when the doped region is reached.

In order to protect the silicon from chemical influences due to the ink liquid and from cavitation damage as a result of the vaporizing process the substrate 19 is provided with a cavitation protection film 21. The heating element 4 is encapsulated by a $SiO_2$ protective film 22. Silicon nitrite which is deposited e.g. by gas phase deposition can be used for the cavitation film 21.

The heating elements 4 are arranged on the outlet side of the substrate 19 adjacent to the outlet openings 10 above the hollow spaces 16, while the hollow spaces 16 themselves are constructed by anisotropic etching from the rear. A so-called etch stop is used to define the depth of the hollow space so that the hollow space 16 is sealed toward the outlet side by the carrier layer (diaphragm) 20. The etch stop can be realized either by means of a suitably doped silicon layer with good heat conduction or by an insulator of a suitable silicon-on-insulator (SOI) system. Systems of dielectric layers adapted to silicon with respect to voltage compensation and thermal expansion are also suitable for the etch stop. Further, a plurality of heating elements 4 can be associated with an outlet nozzle 10, which heating elements 4 have different geometrical dimensions in order to improve the drop volume modulation. The spreading direction of the steam bubble 5 is opposed to the ink shooting direction (back shooter principle) due to the arrangement of the heating elements 4 to the side of the outlet opening 10. It also lies within the framework of the invention to accommodate a plurality of units of outlet openings 10 and heating elements 4 on a chip 11, e.g. a plurality of staggered rows of nozzle openings for ink liquid of one color or nozzle rows for ink liquids of different colors. According to a further development the heating elements 4 can also be structured so as to achieve a homogeneous temperature distribution on the silicon tongue located below them.

To prevent the formation of troublesome ink puddles on the outside of the ink print head, the shoot out side of the chip 11 is provided with a surface layer 23 which is difficult to wet. The coating is effected before the outlet opening (nozzle opening) 10 is etched through so as to prevent the moisture resistant coat from penetrating into the hollow space structure 16 which causes problems in conventional print heads.

The quantity of required outlet openings (nozzles) 10 in high-resolution printers amounts to 50 to 100 and a plurality of heating elements 4 etc. are associated with a nozzle 10. Up to several hundred lines are accordingly required as a rule.

Aside from the cost for the electrical contacts, the space requirement for the lines and the contact surfaces plays a major role. For example, the space requirement for the lines and contacting surfaces is approximately 96% of the total surface area of the chip 11 in a high-resolution print head with 50 nozzles. According to a further development of the invention a diode circuit (coincidence circuit), known per se, integrated on the substrate can reduce the quantity of required contacts to a value of $2\times\sqrt{n}$, where n equals the number of heating elements to be controlled. The space requirement for the feed lines can be reduced at the same time.

An even more drastic reduction in the electrical contacts and space requirement up to two supply lines and two or three signal lines can be achieved when final amplifiers and signal processing components such as series-parallel converters and/or a character generator are integrated on the substrate.

We claim:

1. An ink print head operating on a heat converter principle, comprising:

a supply vessel for storing a supply of ink including at least one supply conduit; and a cover plate including an outlet side and an ink supply side and having a plurality of outlet openings extending through the cover plate and a plurality of ducts formed on said ink supply side, each duct being in fluid communication with a respective one of said plural outlet openings and positioned to provide a passage for ink stored in said supply vessel through said at least one supply conduit and outwardly from the ink print head, said cover plate including a plurality of individually controllable electrothermal converter elements and at least one electrothermal converter element arranged on the outlet side of said cover plate and positioned adjacent to and laterally offset from a respective one of the plural outlet openings and operable to produce a steam bubble which spreads in the respective duct towards said supply vessel and in a direction opposite to a direction of passage of the ink from the supply vessel, through said respective duct and outlet opening and outwardly from the ink print head.

2. The ink print head of claim 1, further comprising at least two electrothermal converter elements arranged on said cover plate adjacent to and laterally offset from a respective one of each of said plural outlet openings, said at least two electrothermal converter elements having different geometric dimensions to provide improved drop volume modulation.

3. The print head of claim 1, further comprising at least two electrothermal converter elements arranged on said cover plate adjacent to and laterally offset from a respective one of each of said plural outlet openings, said at least two electrothermal converter elements being positioned on opposing sides of said respective outlet opening.

4. The print head of claim 1, wherein said cover plate comprises a chip and said plural outlet openings are arranged in a plurality of rows, each of said plural rows being in fluid communication with a respective supply conduit to provide a passage for ink from said supply vessel outwardly from said print head.

5. The print head of claim 1, further comprising a plurality of supply vessels each storing a different color ink liquid, and wherein said cover plate comprises a chip and said plural outlet openings are arranged in a plurality of rows, each row of outlet openings being in fluid communication with a respective supply conduit to provide a passage for ink from a respective one of said plural supply vessels outwardly from said print head.

6. The print head of claim 1, further comprising a plurality of electrical contacts; a plurality of electric lines connected between said plurality of electrothermal converter elements and said plurality of electrical contacts; and a coincidence circuit including diodes connected to said plurality of electric lines.

7. The print head of claim 1, wherein the cover plate comprises a chip, and further comprising final amplifiers and signal-processing components monolithically integrated in said chip.

8. The print head of claim 7, wherein said signal-processing components are at least one of series-parallel converters, character generators and grid generators.

9. The print head of claim 1, wherein the cover plate comprises a chip formed of a substrate and including an outlet side and an ink supply side opposite the outlet side, each of said electrothermal converter elements being positioned adjacent a respective outlet opening above said plurality of supply conduits on said outlet side.

10. The print head of claim 9, wherein said substrate is silicon, and said electrothermal converter elements being positioned to obtain a homogenous temperature distribution throughout the silicon substrate.

11. The print head of claim 9, further comprising a cavitation protection layer positioned on said ink supply side of said cover plate and covering said electrothermal converter elements.

12. The print head of claim 11, wherein said cavitation protection layer is formed of silicon nitrate deposited by low-pressure gas phase deposition.

13. The print head of claim 1, wherein said at least one supply conduit extends longitudinally along an upper surface of said supply vessel.

14. A process of producing an ink print head operating on a heat converter principle and including a supply vessel for storing a supply of ink and including at least one supply conduit, and a cover plate including an outlet side and an ink supply side having a plurality of outlet openings and a plurality of ducts, each said duct being positioned on the supply side and in fluid communication with a respective one of the plural outlet openings, and the cover plate being positioned to provide a passage for ink stored within the supply vessel and extending through the at least one supply conduit, a respective duct and a respective outlet opening and outwardly from the ink print head, comprising the steps of:

arranging at least one electrothermal converter element on the outlet side of the cover plate adjacent and laterally offset from each of said plural outlet openings;

providing a plurality of electric contacts on the outlet side of the cover plate; and connecting each of said plurality of electric contacts with a respective one of the at least one converter elements through a respective electric line such that when a charge is applied to an electric converter element through the respective electric line and electric contact a steam bubble is caused to form in the duct communicating with the outlet opening adjacent the electric converter element and the steam bubble spreads in a direction opposite a direction of passage of ink outwardly from the ink print head, said steps of arranging, providing and connecting being performed using planar processing.

15. The process of claim 14, wherein said step of producing the cover plate comprises the step of anisotropically etching the plural ducts.

16. The process of claim 14, wherein said step of producing the cover plate comprises the steps of forming the cover plate using monocrystalline silicon in 110 orientation as a substrate, and effecting masking of the cover plate by forming an elongated opening having parallel side edges to form the plurality of ducts having parallel walls defined by 111 planes and inclined run-off zones.

17. The process of claim 15, wherein said step of producing the cover plate further comprises the steps of limiting the depth of each of the plural ducts using an etch stop; and closing off the plurality of ducts on the supply side using a diaphragm.

18. The process of claim 17, wherein the step of limiting each of the plural ducts comprises the step of forming the etch stop from a doped silicon layer having good heat conduction characteristics.

19. The process of claim 17, wherein the step of limiting the ducts comprises the step of forming the etch stop from an insulator of a silicon-on-insulator system.

20. The process of claim 17, wherein the step of limiting the ducts comprises the step of forming the etch stop from systems of dielectric layers adapted to silicon with respect to voltage compensation and thermal expansion.

21. The process of claim 17, further comprising the step of covering the diaphragm with a cavitation protection layer.

22. The process of claim 21, further comprising the step of depositing silicon nitrite by low-pressure gas phase deposition to produce the cavitation layer.

23. The process of claim 14, wherein the step of producing the cover plate comprises the step of etching the outlet side of the cover plate to produce the plurality of outlet openings.

24. The process according to claim 23, wherein the step of producing the cover plate further comprises the step of applying a surface coating on the outlet side of the cover plate with a layer able to prevent ink puddles from forming on the outlet side prior to etching the plurality of outlet openings.

25. The process of claim 14, wherein said at least one supply conduit extends longitudinally along an upper surface of said supply vessel.

* * * * *